US008187529B2

(12) United States Patent
Powell

(10) Patent No.: US 8,187,529 B2
(45) Date of Patent: May 29, 2012

(54) WEAR RESISTANT ALLOY AND METHOD OF PRODUCING THEREOF

(75) Inventor: Graham Leonard Fraser Powell, Belair (AU)

(73) Assignee: Global Tough Alloys Pty Ltd., Reynella (AU)

( * ) Notice: Subject to any disclaimer, the term of this patent is extended or adjusted under 35 U.S.C. 154(b) by 957 days.

(21) Appl. No.: 11/666,304

(22) PCT Filed: Oct. 27, 2004

(86) PCT No.: PCT/AU2004/001481

§ 371 (c)(1),
(2), (4) Date: Jan. 16, 2009

(87) PCT Pub. No.: WO2005/040441

PCT Pub. Date: May 6, 2005

(65) Prior Publication Data

US 2010/0080727 A1 Apr. 1, 2010

(30) Foreign Application Priority Data

Oct. 27, 2003 (AU) ..... 2003905888

(51) Int. Cl.

| | |
|---|---|
| ***C22C 37/06*** | (2006.01) |
| ***C22C 37/08*** | (2006.01) |
| ***C22C 37/10*** | (2006.01) |
| ***C22C 38/08*** | (2006.01) |

(52) U.S. Cl. ..... 420/16; 420/15; 420/17; 420/26; 420/27; 420/29; 148/324; 148/543

(58) Field of Classification Search ..... 420/15–17, 420/26, 27, 29; 148/324, 543
See application file for complete search history.

(56) References Cited

U.S. PATENT DOCUMENTS

| | | | | |
|---|---|---|---|---|
| 3,663,214 | A * | 5/1972 | Moore et al. | 420/15 |
| 4,382,828 | A * | 5/1983 | Henych | 148/542 |
| 4,803,045 | A * | 2/1989 | Ohriner et al. | 420/57 |
| 5,244,559 | A | 9/1993 | Latz | |
| 5,252,149 | A | 10/1993 | Dolman | |

(Continued)

FOREIGN PATENT DOCUMENTS

| | | |
|---|---|---|
| AU | A-28865/84 | 5/1984 |

(Continued)

OTHER PUBLICATIONS

Diesburg D.E. and Borik F. ,"Optimizing Abrasion Resistance and Toughness in Steels and Irons for the Mining Industry Symposium Materials for the Mining Industry," Jul. 30, 1974, pp. 15-41.

(Continued)

*Primary Examiner* — Deborah Yee
(74) *Attorney, Agent, or Firm* — Nixon Peabody LLP; Jeffrey L. Costellia

(57) ABSTRACT

A wear resistant, high chromium white iron, in an unheat-treated condition has a microstructure substantially comprising austenite and $M_7C_3$ carbides. The white iron contains at least one martensite promoter and at least one austenite stabilizer which are present at respective levels to achieve a balance between their effects whereby the white iron has a microstructure characterized by at least one of:

i) being substantially free of martensite at interfaces between the austenite and $M_7C_3$ carbides; and
ii) having a relatively low level of interconnectivity between carbide particles;

such that the white iron is substantially crack-free. The white iron may be as-cast or comprise weld deposited hardfacing.

18 Claims, 9 Drawing Sheets

U.S. PATENT DOCUMENTS

| | | | |
|---|---|---|---|
| 5,702,668 | A | 12/1997 | Ocken et al. |
| 5,803,152 | A | 9/1998 | Dolman et al. |
| 6,375,895 | B1 | 4/2002 | Daemen |

FOREIGN PATENT DOCUMENTS

| | | | |
|---|---|---|---|
| GB | 2 153 846 | | 8/1985 |
| JP | 63-121635 | A | 5/1988 |
| JP | 09-136187 | | 5/1997 |
| RU | 196327/28 | | 12/1987 |
| RU | 149842/15 | | 7/1995 |
| SU | 1656005 | A1 | 3/1989 |
| SU | 1770437 | A1 | 9/1990 |
| WO | WO-84/04760 | | 12/1984 |
| WO | WO-94/27763 | | 12/1994 |

OTHER PUBLICATIONS

Sare I.K., "Abrasion Resistance and Fracture Toughness of White Cast Irons," Metals Technology, Nov. 1979, pp. 412-419.

Powell, G.L.F., "Morphology of Eutectic $M_3C$ and $M_7C_3$ in White Iron Castings," Metals Forum (1980) vol. 3, No. 1, pp. 37-46.

Powell, G.L.F. and Heard, L.S., "Misinterpretation of Microstructure in Wear Resistant Alloy White Irons," Proceedings of the 34th Annual Conference of the Australasian Institute of Metals, 1981, pp. 58-62.

Powell, G.L.F., "A Discussion of High Chromium White Irons as Cast Alloys in Terms of In-Situ Fibrous Composites," May 9, 1982, Presented at 35th Annual Conference of the Australasian Institute of Metals, Sydney, pp. 57-60.

Pearce, J.T.H., "The Use of Transmission Electron Microscopy to Study the Effects of Abrasive Wear on the Matrix Structure of a High Chromium Cast Iron, " Wear, Mar. 1983, vol. 89, pp. 333-344.

Rivlin, V.G., "Phase Equilibria in Iron Alloys 14: Critical Review of Constitution of Carbon—Chromium—Iron and Carbon Iron—Manganese Systems," International Metals Reviews (1984) vol. 29, No. 4, pp. 299-326.

Pearce, J.T.H. and Elwell, D.W.L., "Duplex Nature of Eutectic Carbides in Heat Treated 30% Chromium Cast Iron," Journal of Materials Science Letters (1986), vol. 5, pp. 1063-1064.

Ohriner, E.K. et al., "The Chemistry and Structure of Wear-Resistant, Iron-Base Hardfacing Alloys," Metallurgical Transactions, vol. 22A, May 1991, pp. 983-991.

Powell, G.L.F. and Laird, G., "Structure, Nucleation, Growth and Morphology of Secondary Carbides in High Chromium and Cr-Ni White Cast Irons," Journal of Materials Science (1992) vol. 27, pp. 29-35.

Laird, G.II. and Powell, G.L.F., "Solidification and Solid-State Transformation Mechanisms in Si Alloyed High-Chromium White Cast Irons," Metallurgical Transactions, vol. 24A, Apr. 1993, pp. 981-988.

Powell, G.L.F. and Bee, J.V., "Matrix Compositions and the Corrosion and Oxidation Behavior of High Chromium White Irons," Jun. 17, 1993, (Presented at "Materials and Manufacturing in Mining and Agriculture," Brisbane, Australia), pp. 21-27.

Kootsookos, A., "Development of a White Cast Iron of Fracture Toughness 40MPa√m," Cast Metals (1994) vol. 7, No. 4, pp. 239-246.

Powell, G.L.F. and Randle, V., "The Morphology and Microtexture of $M_7C_3$ Carbides in Fe-Cr-C and Fe-Cr-C-Si Alloys of Near Eutectic Composition," Journal of Material Science, 1994, pp. 4889-4896.

Doğan, Ö.N. et al., "Abrasion Resistance of the Columnar Zone in High Cr White Cast Irons," Wear (1995), vol. 181-183, pp. 342-349.

Tabrett, C.P. et al., "Microstructure—Property Relationships in High Chromium White Iron Alloys," International Materials Reviews; (1996), vol. 41, No. 2, pp. 59-82.

Powell, G.L.F. and Bee, J.V., "Secondary Carbide Precipitation in an 18 wt %Cr-1 wt % Mo White Iron," Journal of Materials Science, (1996) vol. 31, pp. 707-711.

Hann, S.K. and Gates, J.D., "A Transformation Toughening White Cast Iron," Journal of Materials Science (1997) vol. 32, pp. 1249-1259.

Tabrett C.P, and Sare, I.R., "Fracture Toughness of High-Chromium White Irons: Influence of Cast Structure," Journal of Materials Science (2000) vol. 35, pp. 2069-2077.

Powell, G.L.F. and Bee, J.V., "Influence of Microstructure on Premature Failure of High Cromium White Iron Hardfacing Weld Deposits," Welding Research Supplement 2000, Australasian Welding Journal (2000) vol. 45, Second Quarter, pp. 33-35.

Zhang, M.X., et al., "The Effect of Heat Treatment on the Toughness, Hardness and Microstructure of Low Carbon White Cast Irons," Journal of Materials Science (2001) vol. 36, pp. 3865-3875.

Powell, G.L.F. and Brown, I.H., "Hardfacing—A New Approach to Vastly Improve Performance," Oct. 8, 2001 (Presented at WTIA Smart Technet Project 49th Annual Conference, Adelaide, SA), pp. 1-10.

Pearce , J.T.H., "High Chromium Cast Irons to Resist Abrasive Wear," Foundryman, Apr. 2002, pp. 156-166.

Powell G.L.F., "Improved Wear-resistant High-alloyed White Irons-A Historical Perspective," Aug. 16, 2002, (Presented at Abrasion Japan Foundry Engineering Society, Fukuoka, Japan), pp. 1-10.

Powell, G.L.F et al., " Interpretation of Microstructure in High Chromium White Iron Weld Deposits," Sep. 8, 2003 (Presented at WTIA Technology Week), pp. 1-9.

Kootsookos, A. and Gates, J.D., "The Effect of the Reduction of Carbon Content on the Toughness of High Chromium White Irons in the As-Cast State," Journal of Materials Science (2004) vol. 39, pp. 73-84.

Carpenter S.D. et al., "XRD and Electron Microscope Study of an as-cast 26.6% Chromium White Iron Microstructure," Materials Chemistry and Physics (2004) vol. 85, pp. 32-40.

Wiengmoon A., et al., "A Microstructural Study of Destabilised 30wt%Cr-2.3wt%C High Chromium Cast Iron," ISIJ International, (2004) vol. 44, No. 2, pp. 396-403.

Llewellyn R.J., "High Chromium White Irons for Slurry Pump Service in Mineral Processing," CIM Conference Presentation (May 2004), 10 pages.

Llewellyn, R.J., "Gouging Abrasion Resistance of Materials for Oil Sands Service," CIM Conference Presentation (May 2004), 10 pages.

Llewellyn R.J., "Scouring Erosion Resistance of Metallic Materials Used in Slurry Pump Service," Wear, (2004) vol. 256, No. 6, pp. 592-599.

Gundlach, R.B., "High-Alloy White Irons," ASM Handbook, vol. 15: Casting, ASM International Handbook Committee, (1988), pp. 678-685.

Sunghak Lee et al., "Correlation of Microstructure and Fracture Toughness in High-Chromium White Iron Hardfacing Alloys", Metallurgical and Materials Transactions A, Dec. 1996, vol. 27A, pp. 3881-3891.

* cited by examiner

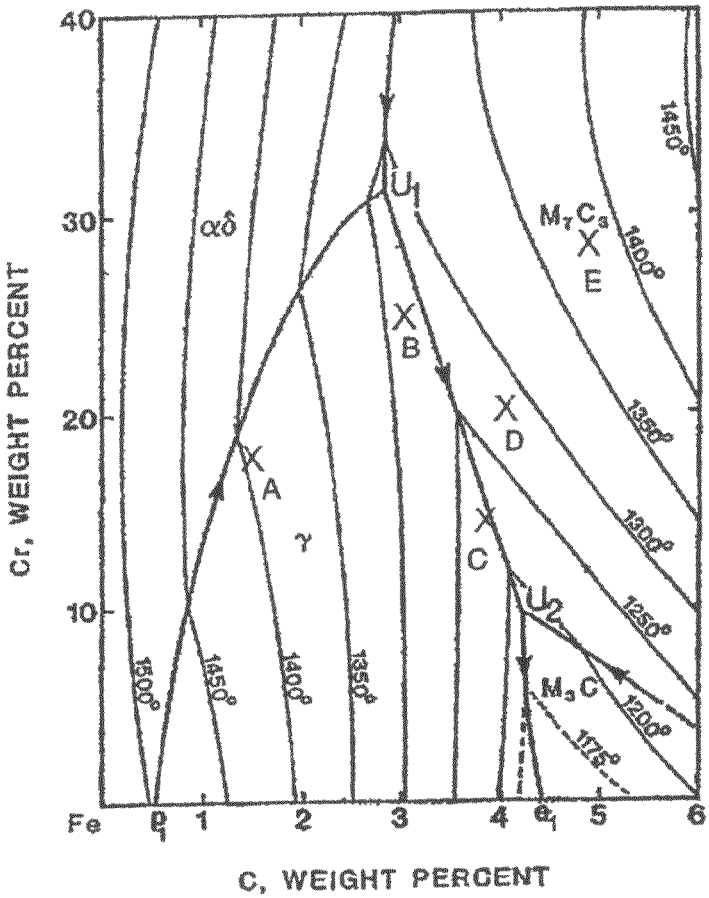
FIG 1
FIG 2
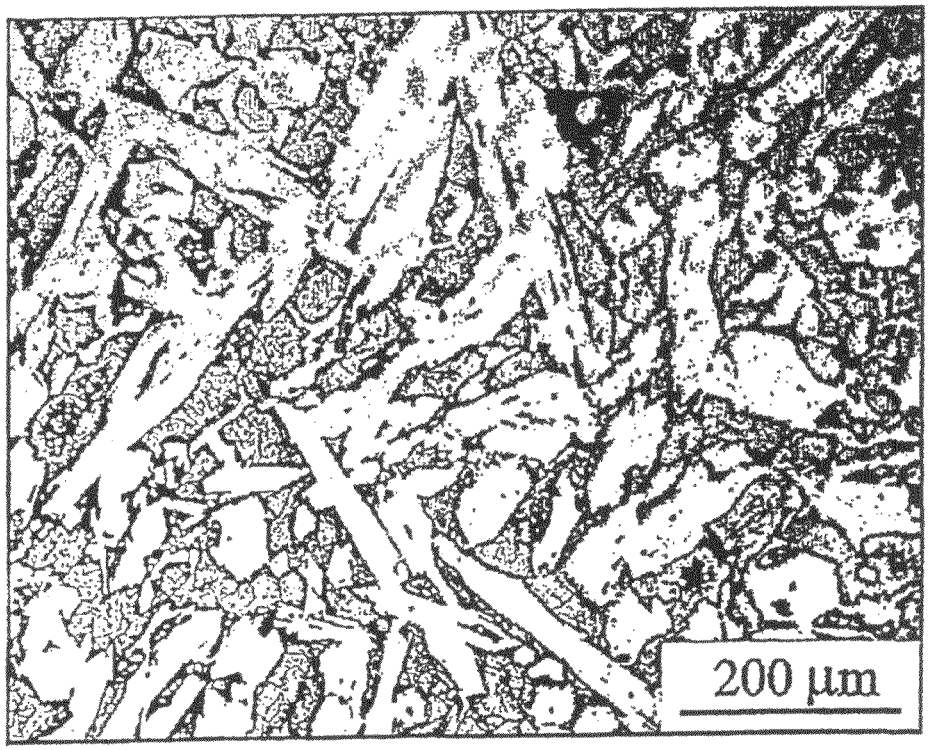

WEAR RESISTANT ALLOY AND METHOD OF PRODUCING THEREOF

FIELD OF THE INVENTION

The present invention relates to wear resistant, high chromium white irons which are suitable for hardfacing of components and also for direct casting of complete products, and which enable improved fracture toughness.

BACKGROUND OF THE INVENTION

Chromium white irons, in particular high chromium white irons, resist wear as a result of their content of very hard $M_7C_3$ carbides, where M is Fe,Cr or Cr,Fe but may include small amounts of other elements such as Mn or Ni, depending upon the composition. The wear resistant high chromium white irons may be hypoeutectic, eutectic or hypereutectic.

The hypoeutectic chromium white irons have up to about 3.0% carbon, and their microstructure contains primary dendrites of austenite in a matrix of a eutectic mixture of $M_7C_3$ carbides and austenite. The eutectic white irons have from about 3.0% to about 4.0% carbon and a microstructure of a eutectic mixture of $M_7C_3$ carbides and austenite. The hypereutectic chromium white irons have from about 3.5% to about 5.0% carbon, while their microstructure contains primary $M_7C_3$ carbides in a matrix of a eutectic mixture of $M_7C_3$ carbides and austenite. In each case, it is the presence of the $M_7C_3$ carbides, either as eutectic carbides or primary carbides, that provides the alloy with its wear characteristics. The hypereutectic white irons are considered to have higher volume fractions of the hard and wear resistant $M_7C_3$ carbides than the hypoeutectic white irons, and are thus often the preferred alloy for many hardfacing applications. However, the hypereutectic white irons generally are not favoured for casting, due to stress induced cracking during cooling.

It is widely recognised in the art that, with the increase in wear resistant properties available with hypereutectic high chromium white irons, there is a corresponding decrease in fracture toughness. High chromium white cast irons are used extensively in mining and mineral processing industries, in applications in which their abrasion resistance is required, but in which relatively low fracture toughness is acceptable. However, there are other applications where low fracture toughness has not been acceptable. This has meant that hypereutectic high chromium white cast irons have not been usable and there have been various attempts to address this.

The background section of Australian patent application AU-A-28865/84, which primarily relates to high chromium white cast irons of both hypoeutectic and hypereutectic compositions, describes the many failed attempts to develop satisfactory hypereutectic white iron alloys for castings, which combine wear resistance with fracture toughness. AU-A-28865/84 also describes various attempts to develop hypoeutectic compositions, and draws on attempts in the art to develop suitable hardfacing alloys as providing possible solutions to the wear resistance vs fracture toughness dilemma. However, AU-A-28865/84 in fact predominantly solves the cracking problem of cast compositions by forming them as cast composites—namely by creating a composite component comprising the preferred alloy metallurgically bonded to a substrate, thus assisting with avoiding the likelihood of cracking upon the cast alloy cooling. Indeed, AU-A-28865/84 seeks to overcome the disadvantages of low fracture toughness and cracking with hypereutectic castings having greater than 4.0 wt. % carbon by ensuring the formation in a composite casting of primary $M_7C_3$ carbides with mean cross-sectional dimensions no greater than 75 micron, and suggests a variety of mechanisms for doing so. Thus, AU-A-28865/84 aims to overcome the problem by forming composite components and limiting the size of the primary $M_7C_3$ carbides in the alloy itself.

U.S. Pat. No. 5,803,152 also seeks to refine the microstructure of, in particular, thick section hypereutectic white iron castings, in order to maximise nucleation of primary carbides, thereby enabling an increase not only in fracture toughness but also in wear resistance. This refinement is achieved by introducing a particulate material into a stream of molten metal as the metal is being poured for a casting operation. The particulate material is to extract heat from, and to undercool, the molten metal into the primary phase solidification range between the liquidus and solidus temperatures.

In relation to previous attempts to improve fracture toughness in hardfacing alloys, U.S. Pat. No. 6,375,895 points out that most prior art high chromium white irons for hardfacing always show a more or less dense network of cracks (or check cracking) in the as-welded condition, despite precautions to avoid this. U.S. Pat. No. 6,375,895 indicates that the comparative hardness of primary carbides (about 1700 Brinell hardness number (BHN)) in a soft austenite matrix (about 300 BHN to 600 BHN) gives rise to shrinkage cracks on cooling from the molten state. The solution offered by U.S. Pat. No. 6,375,895 is to adopt a particular alloy composition, preheating of the base component to be hard-faced, and subsequent cooling regimes, that ensure a substantial martensitic presence in the microstructure and a consistent hardness (about 455 BHN to 512 BHN) throughout the alloy.

It is an aim of the present invention to provide a wear resistant, high chromium white iron that is able to be cast or used as a hardfacing alloy substantially crack free. When used to produce castings, the white iron of the invention does not require the formation of composite components, or the use of complex casting techniques. Also, the use of costly pre-heating techniques are not necessary for use of the white iron for hardfacing.

Before turning to a summary of the invention, it is to be appreciated that the previous description of prior art is provided only for background purposes. Reference to this prior art is not to be considered as an acknowledgement that the disclosure of any of the documents considered is well known or has entered the realm of common general knowledge in Australia or elsewhere.

SUMMARY OF THE INVENTION

The present inventor has been the first to recognise the causes of the fracture toughness problem with wear-resistant, high chromium white irons. The inventor has recognised the presence of a thin layer of martensite at interfaces between the $M_7C_3$ carbides and the austenite, and has also recognised that this thin layer of martensite enables or at least initiates cracking. This applies whether the $M_7C_3$ carbides are primary carbides and the austenite is that of eutectic matrix, or the $M_7C_3$ carbides are eutectic carbides and the austenite is of the eutectic or, where relevant, the austenite is primary austenite. Thus, the findings apply to hypoeutectic, eutectic and hypereutectic high chromium white irons for use in producing castings. The findings also apply to eutectic and hypereutectic alloys used for weld deposition and for many, if not all, hypoeutectic alloys used for weld deposition.

The inventor has additionally determined that this thin layer of martensite is normally less than 1 micron thick, but may be up to several microns thick, or may be as thin as several nanometers. The layer may not be entirely continuous about a carbide and may not be uniform in thickness. Such a layer will of course only normally be visible using electron microscopes or the like.

Our findings indicate that the presence of the thin layer of martensite ordinarily results in the high chromium white irons from a decrease in chromium and carbon content in the austenite adjacent the $M_7C_3$ carbides, and the influence of silicon content increasing the tendency for the formation of martensite in the austenite adjacent to the $M_7C_3$ carbides.

By way of explanation, weld deposits formed during hardfacing are subjected to residual tensile stresses due to shrinkage during cooling after the weld solidifies. We have found that the thin, hard and brittle layer of martensite adjacent the $M_7C_3$ carbides relieves these tensile stresses by cracking. In the absence of this thin layer of martensite, the softer austenite is able to deform to accommodate the residual tensile stresses, obviating the initiation of cracking and minimising crack propagation where some microcracking still occurs.

The inventor additionally has found that martensite at the interfaces between $M_7C_3$ carbides and austenite is not the sole cause of cracking of castings and weld deposited hardfacing. A further major cause, as detailed later herein, is the formation of $M_7C_3$ carbides having a high level of interconnectivity. Some alloy additions are found to increase interconnectivity of the $M_7C_3$ carbide where the level of at least one of the additions is such that undercooling of the melt occurs before solidification. This applies to both castings and to weld deposits and where this is in conjunction with the presence of martensite at $M_7C_3$ carbide and austenite interfaces, crack initiation and propagation essentially is unable to be avoided. Where $M_7C_3$ carbide interconnectivity occurs in alloys which are not prone to the presence of martensite at those interfaces, that source of crack initiation is avoided, although crack initiation and propagation still is largely unavoidable.

The inventor has found that, in large part, the solution to both sources of crack initiation and propagation in high chromium white irons, whether used in castings or weld deposition, is the same.

The present invention provides a wear resistant, high chromium white iron, wherein said white iron in an unheat-treated condition has a microstructure substantially comprising austenite and $M_7C_3$ carbides and wherein said white iron contains at least one martensite promoter and at least one austenite stabiliser, with said martensite promoter and austenite stabiliser being present at respective levels to achieve a balance between their effects whereby the white iron in an unheat-treated condition has a microstructure characterised by at least one of:

i) being substantially free of martensite at interfaces between the austenite and $M_7C_3$ carbides; and ii) having a relatively low level of interconnectivity between carbide particles;

such that the white iron is substantially crack-free. In most, if not substantially all instances, the white iron not only is substantially crack-free but also has improved fracture toughness.

In one form, the white iron is in an as-cast condition and said respective levels achieve a balance whereby the white iron is substantially free of martensite at interfaces between the austenite and $M_7C_3$ carbides.

In another form, the white iron comprises hardfacing provided over a substrate by weld deposition, and the hardfacing is substantially free of check cracking. The balance between the effects of the martensite promoter and the austenite stabiliser may be such that $M_7C_3$ carbides of said microstructure exhibit a relatively low level of interconnectivity between carbide particles. The low level of interconnectivity preferably is such that the microstructure is substantially free of branched carbide particles and, where relevant, said respective levels also achieve a balance whereby the white iron is substantially free of martensite at interfaces between the austenite and $M_7C_3$ carbides.

The present invention provides wear-resistant, high chromium white iron alloys having substantially no martensite at interfaces between the $M_7C_3$ carbides and austenite such that the alloys, either as-cast or as deposited for hardfacing, are substantially crack free. However, it is to be appreciated that reference to there being substantially no martensite at those interfaces does not preclude the presence of some martensite within austenitic regions away from the interfaces. The invention is characterised by the prevention of the formation of the thin layer of martensite at interfaces between the $M_7C_3$ carbides and austenite, and does not necessitate the total exclusion of all martensite, although this may occur. Indeed, in some compositions the presence of martensite other than at those interfaces is desirable.

In another form, the present invention provides a wear-resistant, high chromium white iron having a sufficient balance of at least one martensite promoter and at least one austenite stabiliser such that there is substantially no martensite at interfaces between the $M_7C_3$ carbides and austenite such that the white iron, either as-cast or as-deposited for hardfacing, is substantially crack free.

Silicon, as a martensite promoter, is a member of the group of alloying elements that act to promote the formation of martensite. Alloying elements of that group also include boron. In high chromium white irons according to the present invention, silicon is the martensite promoter of principal importance for the purpose of achieving the required balance with the at least one austenite stabiliser. However, boron can be used as a martensite promoter, such as up to about 1% or even as high as 2%. The boron can influence the action of silicon, or it can be used as the sole martensite promoter. In general, the control required by the invention is described herein with reference to silicon as the martensite promoter and to the at least one austenite stabiliser, although it is to be borne in mind that boron can be used as martensite promoter.

The at least one austenite stabiliser is a member of the group of alloying elements that act to promote and stabilise the formation of austenite. Alloying elements of that group include manganese, nickel, copper and molybdenum. These elements can be used alone or in combination. Of these four elements, manganese and nickel are found to be particularly beneficial for the purpose of the present invention. The control required by the invention therefore is described with reference to manganese and/or nickel as the austenite stabiliser, although minor amounts of at least one of the other austenite stabilisers can be present in addition. Also, it is to be borne in mind that the other stabilisers can be used instead of manganese and/or nickel.

In a preferred form of the invention, the thin layer of martensite at interfaces between $M_7C_3$ carbides and austenite is avoided by a 'sufficient balance' of various alloying elements, in the form of suitable amounts of austenite stabilisers (such as manganese and/or nickel) and martensite promoters (such as silicon and/or boron). The term 'sufficient balance' is a functional reference to the amount of those alloying elements that are present in the chromium white iron such that a resultant casting or hard-facing is substantially crack free.

With further regard to these alloying elements, martensite promoters such as silicon have been suggested for addition to some chromium white irons to increase the fluidity of the melt during hardfacing or casting. However, the present inventor has also determined that the presence of a martensite promoter such as silicon can produce a previously unsuspected cumulatively deleterious result. It has been found that the presence of the martensite promoter can have the opposite effect to the preferred austenite stabilisers (manganese and nickel) upon the formation of martensite. Thus, it has been found that the martensite promoter can act not merely to promote the formation of martensite, but specifically to promote martensite formation at interfaces between austenite and $M_7C_3$ carbides. Hence the reason for the balance of martensite promoter, such as silicon, and austenite stabilisers.

Despite being known to promote martensite, silicon is added or tolerated to substantial levels because its effect as a martensite promoter has been believed to be offset by the use of austenite stabilisers. That is, the perception has been that sufficient austenite stabilisation is able to be achieved, despite the presence of silicon, such that the net result is that the beneficial effect of silicon in increasing melt fluidity is able to be achieved without disadvantage. This perception is supported by the commonly used metallographic techniques. For chromium white irons in which martensite suppression has been sought, the resolution of photomicrographs obtained by those techniques show primary austenite and eutectic matrix for hypoeutectic irons and primary $M_7C_3$ carbides and eutectic matrix for hypereutectic irons. The resolution is such that, the eutectic is perceived as comprising $M_7C_3$ carbides and austenite, without martensite. In the case of dendrites of hypoeutectic white irons, those resolutions may show primary dendrites as comprising austenite alone or as comprising austenite within which there may be regions of martensite, as anticipated. In the latter case, the martensitic regions would be considered to be acceptable, given that they are contained within austenite. In each case, the photomicrographs show what is expected and there is no reason to look further as cracking appears to be satisfactorily explained by residual stress.

As indicated, we have found that silicon is able to have an active, if previously unsuspected, role in promoting the formation of martensite despite austenite stabilisation. That role is deleterious in that the martensite formed is at the interfaces between $M_7C_3$ carbides and austenite. This can be carbides and austenite of the eutectic phase, or primary austenite and eutectic carbide or primary carbide and eutectic austenite, or relevant combinations of these situations.

It remains desirable to have a silicon content which has the known beneficial effect of increasing fluidity. However, it is not simply a matter of having a required level of silicon for this purpose and offsetting the adverse action of silicon as a martensite promoter by adding at least a sufficient excess of austenite stabilizer. One factor is the added cost of excess austenite stabiliser. However a more important reason is provided by a further complex influence of silicon on the microstructure. We have found that, depending on the level at which silicon is present, silicon can either increase or decrease the interconnectivity of $M_7C_3$ carbides. This is of particular relevance to hypereutectic white irons, but also applies to hypoeutectic irons.

In the section under the heading "High-Chromium White Irons" at page 681, ASM Handbook, Volume 15, Castings, $9^{th}$ Edition, these white irons are said to be "distinguished by the hard, relatively discontinuous $M_7C_3$ eutectic carbides". In the case of hypereutectic irons, there also are large hexagonal rods of primary $M_7C_3$ carbides, and these also are perceived to be at least substantially discontinuous. However, as indicated herein, silicon can influence the extent of carbide interconnectivity, both within eutectic carbide and within primary carbide. An increase in $M_7C_3$ carbide interconnectivity increases overall brittleness and facilitates crack initiation and propagation, while a decrease in interconnectivity enables the tough austenite phase to limit both crack initiation and propagation.

Silicon can increase the undercooling in the melt before solidification occurs which increases interconnectivity of eutectic $M_7C_3$ carbides and, for hypereutectic microstructures, increases the interconnectivity of primary $M_7C_3$ carbides. Overall brittleness of a casting or weld deposit therefore increases. However, if silicon is present at a controlled level such that no substantial undercooling occurs, it has been found that the silicon can serve to decrease the interconnectivity of the primary $M_7C_3$ carbides and of eutectic $M_7C_3$ carbides. With such decrease in interconnectivity, fracture toughness, wear resistance and the resistance to thermal shock are increased. Higher levels of silicon can be applied to reduce the interconnectivity of eutectic $M_7C_3$ carbides in hypoeutectic compositions as the complex regular eutectic with high interconnectivity does not form in hypoeutectic alloys.

We have found that there is a further factor, of particular relevance to casting, which preferably can be taken into account in determining the level of silicon. In current practice, a slow cooling rate is used in casting chromium white irons. In relation to those irons, it is stated at page 683 of the above-detailed ASM Handbook under the heading "Shakeout Practices" that "Cooling all the way to room temperature in the melt is desirable and can be a requirement to avoid cracking, especially if martensite forms during the last stages of cooling". It further is indicated that this precaution can be mandatory in heavy-section castings, and that a frequent cause of high residual stresses and of cracking is extracting castings from the mould at too high a temperature. That is, cracking principally has been attributed to cooling rate, with slower cooling rates reducing the risk of crack formation and propagation.

Our finding is that, subject to the balance between the at least one martensite promoter, such as silicon, and the at least one austenite stabiliser, an increasing level of silicon enables an increasingly higher cooling rate to be used without risk of cracking. This, of course, is of practical benefit in shortening the foundry production cycle time. However, the finding also is of relevance to welding, in which a high cooling rate is inherent, as a higher silicon content for example further diminishes the risk of cracking due to residual stresses without considering the combined effect of silicon level and cooling rate on $M_7C_3$ interconnectivity.

Taking the above factors into account, it is preferred that the level of silicon in chromium white irons according to the invention is from 0.25 to 3.5%. However, more preferably the level is from 0.5 to 3.25%. In some forms (depending on microstructure), the silicon levels should not be higher than about 2.75%, as will be explained below. Boron is somewhat more potent than silicon and, as indicated above, boron need only be present at levels up to about 1%, or only up to about 2%.

Throughout this specification, unless indicated to the contrary the percentages are by weight. For hard facing applications, the percentages allow for dilution by the base metal, such as from 10 to 40%.

In a particularly preferred form of the invention, the austenite stabilisers manganese and nickel are both present in the alloy in an amount of from 4.0% to about 12%, such as from 4.0% to 8.0% in order to assist in preventing the transformation of austenite to the martensite. However, it is to be understood that it is not essential for both to be present—as the presence of only one of these elements, in the preferred range mentioned, can suffice. Also, while manganese and/or nickel can be present at up to about 12% in at least some instances the preferred range is from 4.0% to 8.0%.

When the alternative austenite stabilisers are used, copper typically can be used at substantially the same levels as indicated for manganese and/or nickel. Molybdenum however needs to be used at higher levels to allow for a proportion which forms carbide and, hence, is not available as austenite stabiliser. Thus, it is appropriate to consider an equivalence of molybdenum which provides similar austenite stabilisation to the other alloy additions. However, it is preferred that the two alternatives, if used at all, be used in combination with manganese and/or nickel, and at a relatively low level. This is particularly so with molybdenum in view of its cost.

It is preferred that, where two or more austenite stabilisers are used in combination, the total level of austenite stabiliser is not in excess of about 20%, and more preferably is not in excess of about 16%.

The balance required by the present invention necessitates control of a number of variables. These include the level of silicon, the level of manganese and the level of nickel. Manganese and nickel can be regarded as the one variable, given that in large part they are interchangeable. However, they do differ slightly in their effectiveness as austenite stabilisers, and it therefore is preferred to regard the levels of manganese and nickel as separate variables. A fourth variable is cooling rate. However, as a variable, cooling rate has greater relevance in casting, as the scope for its variation is somewhat limited in weld deposition.

Current indications are that an empirical relationship between the four variables detailed above may be able to be developed. If so, the form of such relationship is unclear, although it appears clear that none of the currently known or used relationship, such as Andrew's relationship for determining the martensite start temperature $M_s$, is relevant to achieving the balance required by the invention. The end result is that, for a high chromium white iron having a given content of each of carbon and chromium, it is necessary to conduct preliminary routine trial castings and weld depositions to determine a suitable balance between silicon and at least one of manganese and nickel. These trials should be conducted at a cooling rate relevant to a production run for which an overall white iron composition is to be settled. Also, in at least some instances, the silicon content will be predetermined and, subject to this not being at a level likely to result in undercooling, the trials thus may reduce to adjusting the manganese and/or nickel content to achieve the required balance.

As a preliminary measure at least, attainment of the balance can be determined by presenting a magnet to the trial casting or weld deposit. If ferromagnetism (indicative of the presence of martensite in the present context) is not evident, at least approximate attainment of the balance has been achieved. However, it is appropriate to proceed beyond this to a metallographic examination to confirm that there is no martensite at the interface between the $M_7C_3$ carbides and the austenite.

In the high chromium white iron of the present invention, the amount of chromium present is preferably from 8% to 50%. More preferably the chromium level is from 10% to 30%. The carbon content will typically be from 1.0% to 6.0%. However, there are overlapping sub-ranges for the level of carbon, depending upon whether the white iron is of hypoeutectic, eutectic or hypereutectic composition. The carbides will thus be predominantly of the $M_7C_3$ type, although small amounts of less hard $M_{23}C_6$ carbides can be present, such as in primary austenite regions.

For a hypoeutectic chromium white iron composition the amount of carbon present usually will be from 1.0% to 3.0%. For a eutectic composition the amount of carbon present will usually be from 3.0% to 4.0%, while a hypereutectic composition usually will have from 3.5% to 5.0%. However, it will be appreciated that these ranges may alter, depending upon the presence of other alloying elements. For instance, if the alloy includes an amount of up to about 10% (total) niobium and/or vanadium (which might be added to precipitate hard niobium and vanadium carbides to increase wear resistance), then the relevant amounts of carbon present in the respective compositions will shift as follows:

| | |
|---|---|
| Hypoeutectic | 2.0% to 4.0% |
| Eutectic | 4.25% to 4.75% |
| Hypereutectic | 5.0% to 6.0% |

There can be further shifting of these ranges, depending on alloying elements. A person skilled in the art will understand how, and in what circumstances, these ranges will shift. However, some explanation is provided in relation to FIG. 1.

GENERAL DESCRIPTION OF THE DRAWINGS

In order that the invention may more readily be understood, reference now is directed to the accompanying drawings, in which:

FIG. 1 shows the liquidus surface projections for chromium white irons in the region of commercial interest;

FIG. 2 is a photomicrograph of a sample taken from a hypereutectic casting according to our form of current practice;

Figure 7:
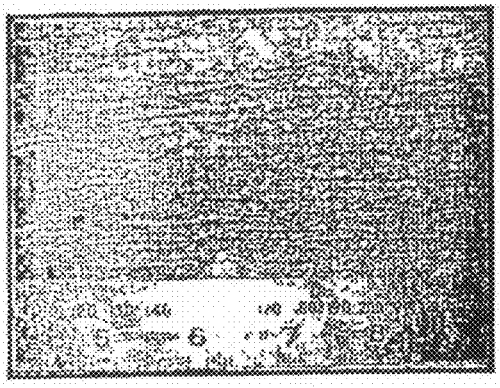
FIG. 7 is a macrograph illustrating check cracking in sample I and typical of weld deposited hardfacing of current practice.
Figure 9:
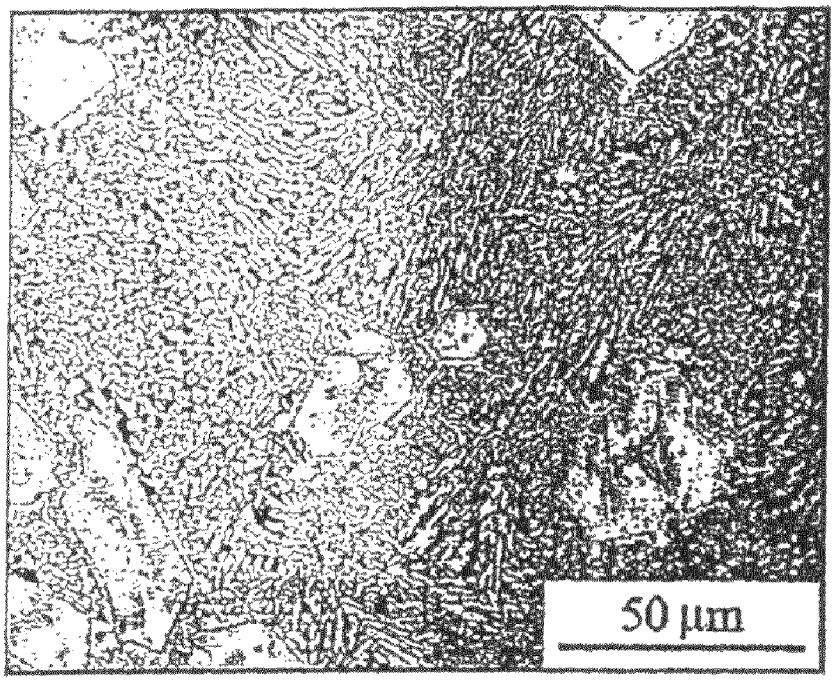
Figure 10:
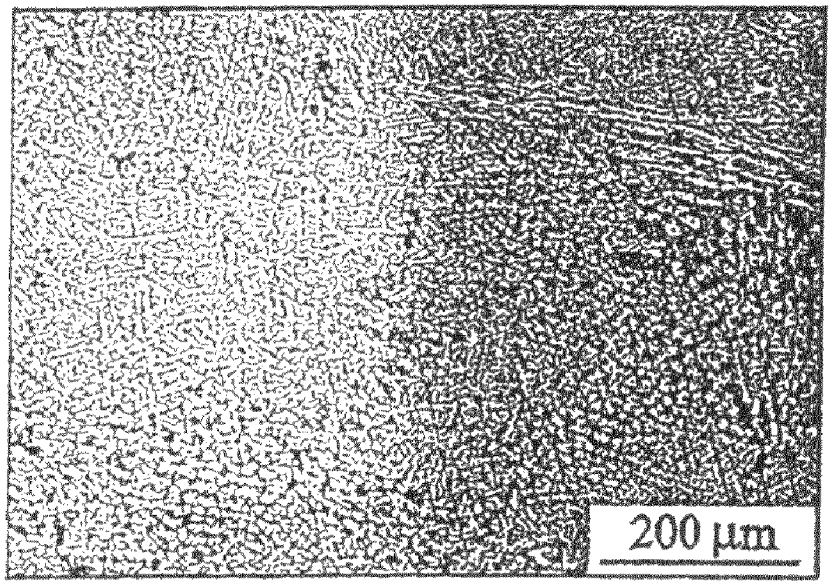
Figure 11A:
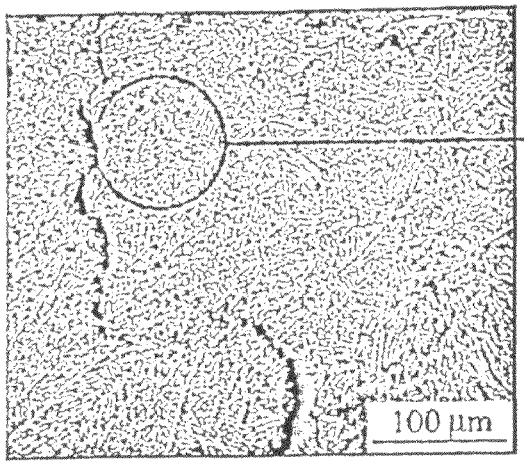
Figure 11B:
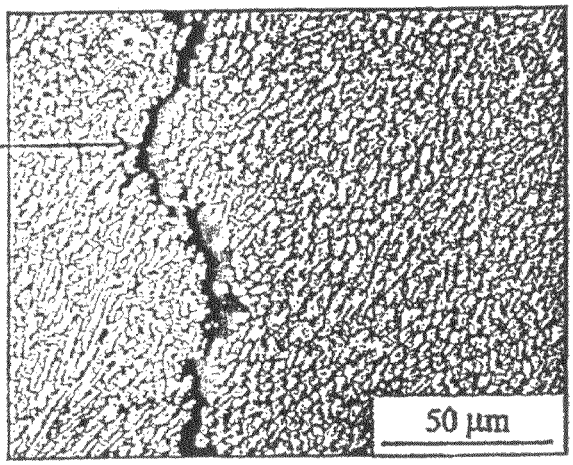
Figure 12:
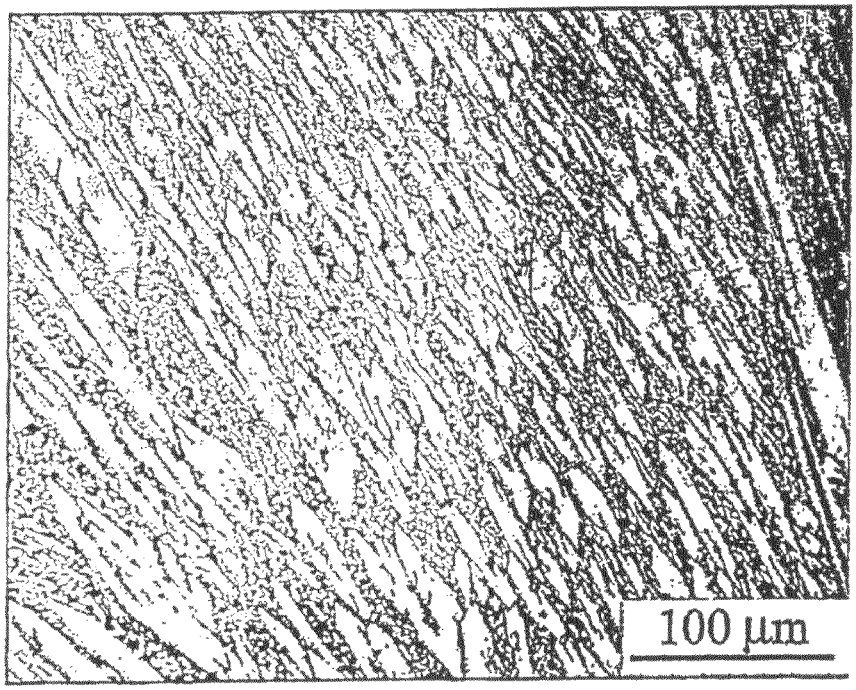
Figure 13:
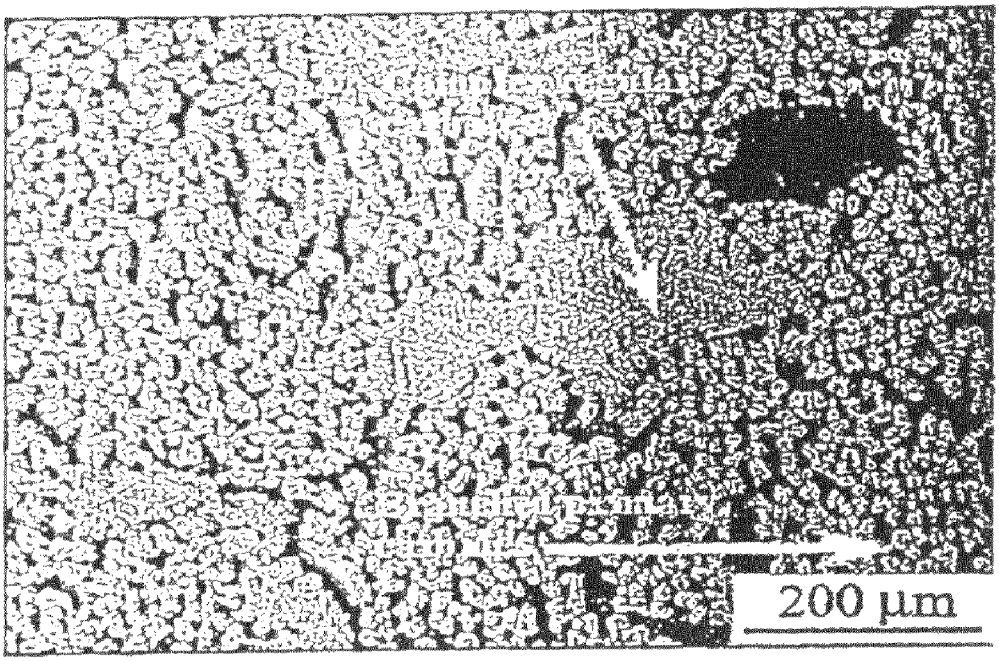
Figure 14:
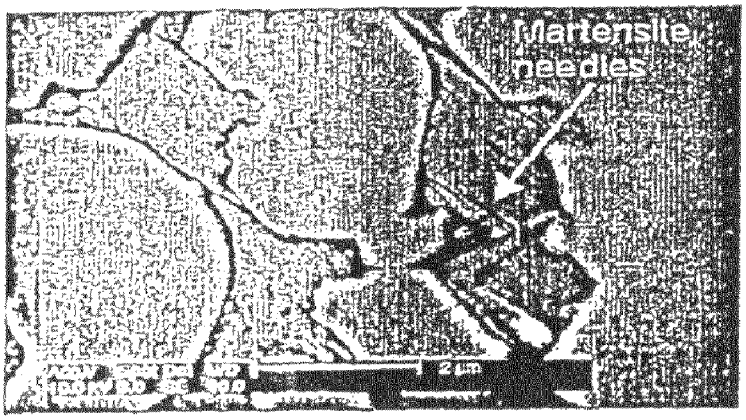
Figure 15:
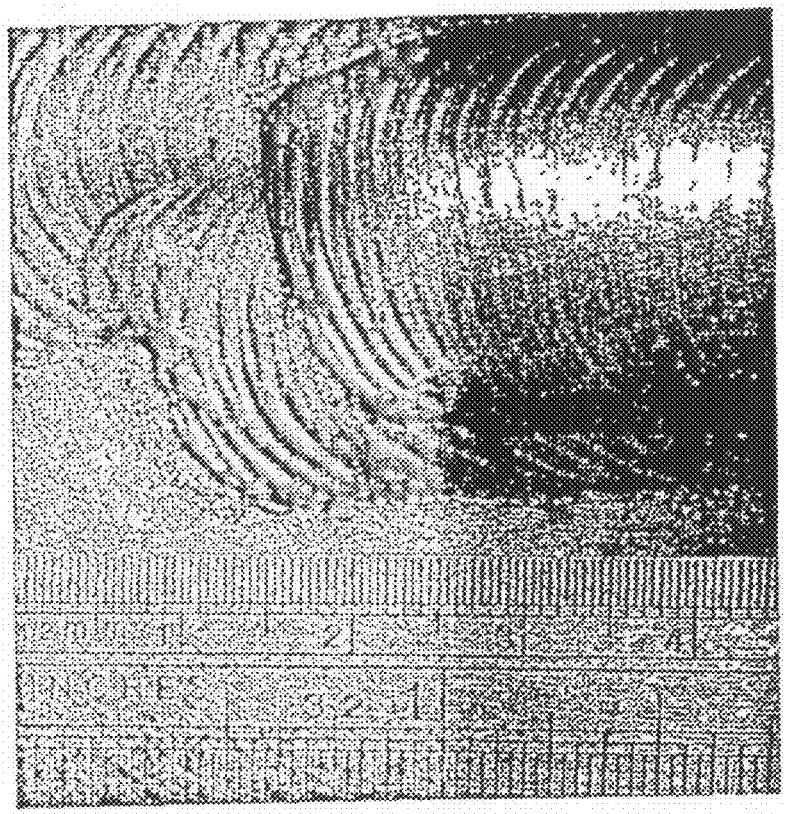
Figure 16:
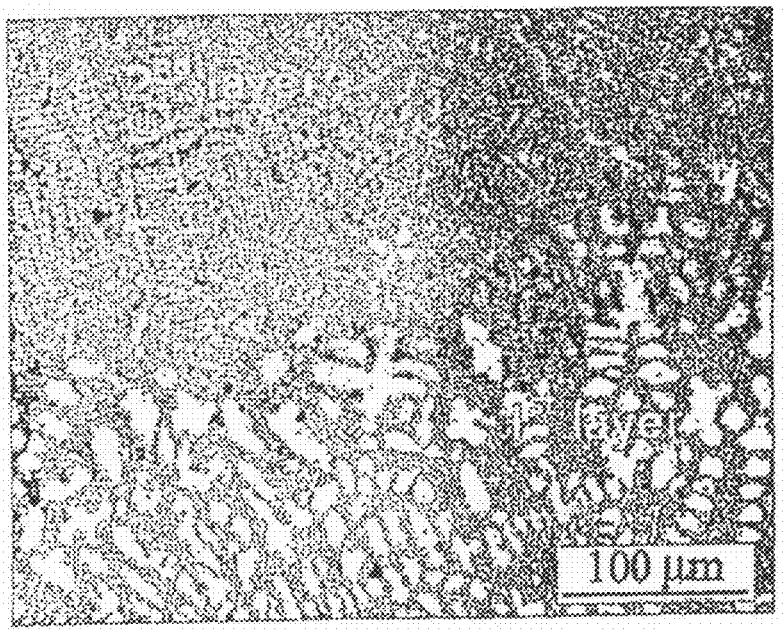
Figure 17:
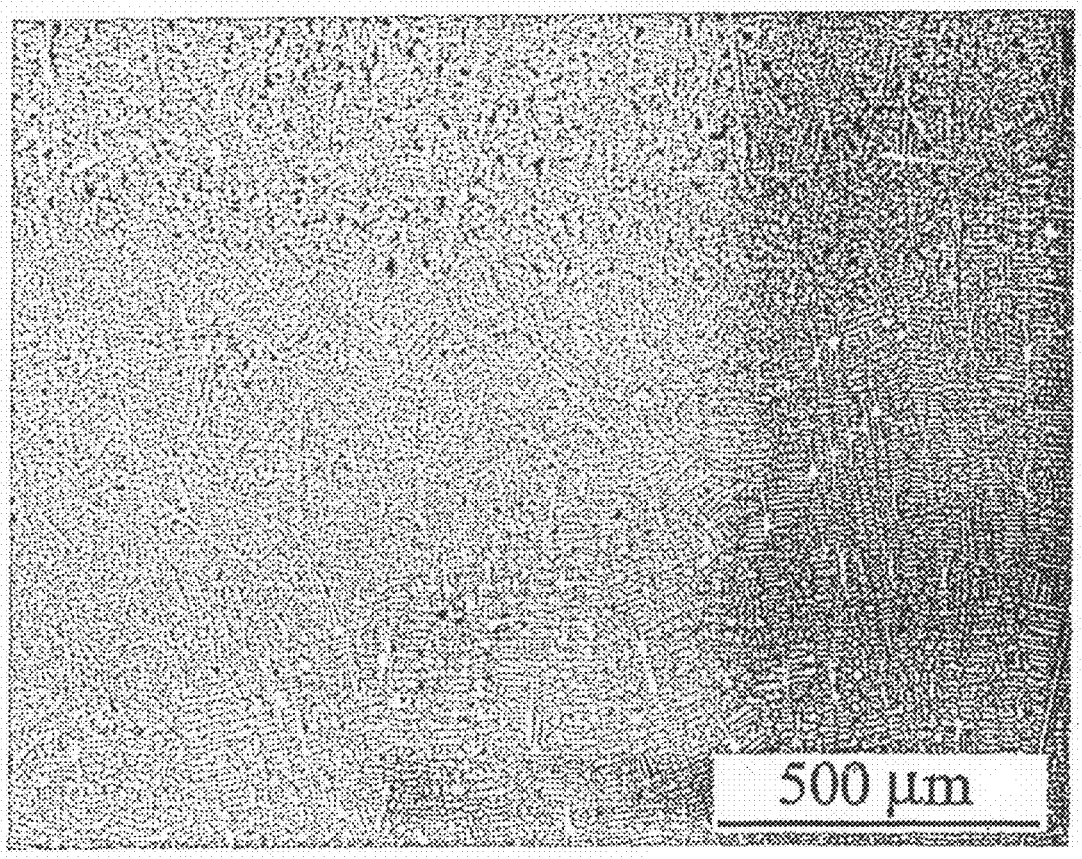

FIGS. 8(*a*) and (*b*) are photomicrographs of the sample shown in FIG. 7;

FIG. 9 is a photomicrograph of sample II of hardfacing of current practice, showing desirable but non-representative microstructure;

FIG. 10 is a photomicrograph of sample III of hardfacing of current practice, showing typical, but undesirable microstructure of that practice;

FIGS. 11(*a*) and 11(*b*) are photomicrographs at respective magnifications, showing a check crack through undesirable microstructure of sample II of FIG. 9;

FIGS. 12 and 13 are respective photomicrographs showing undesirable microstructures for sample III of FIG. 10;

FIG. 14 is an electron micrograph of sample III of FIG. 10, showing a typical further undesirable microstructural feature;

FIG. 15 is a photomacrograph of a weld deposit typical of a high chromium white iron according to the present invention;

FIG. 16 is a photomicrograph taken longitudinally of the direction of application of the weld deposit shown in FIG. 15; and FIG. 17 is a photomicrograph taken transversely of the weld deposit shown in FIG. 15.

DETAILED DESCRIPTION

FIG. 1 illustrates the liquidus surface projections for ternary Fe—Cr—C for high chromium white irons at the Fe-rich corner of metastable C—Cr—Fe liquidus surface. The ternary compositions have up to 6% carbon and up to 40% chromium. They also contain small percentages of manganese and silicon.

The liquidus surface projections in FIG. 1 can be used to show the relationship between microstructure and content of carbon and chromium. The region marked y indicates hypoeutectic compositions. The compositions at points A, B, C, D and E all fall within general ranges herein referred to as Group I.

Compositions A and B fall into the hypoeutectic region and are close to the boundaries. Eutectic microstructures fall on the line from $U_1$ to $U_2$, from a composition close to B along the line to point C. Hypereutectic compositions are within the region marked $M_7C_3$, which includes compositions D and E.

Any cooling regime that tends to enhance or promote the transition of austenite to martensite preferably is avoided. For some compositions it may be preferred to adopt a cooling regime that will not promote the formation of martensite. However, as detailed earlier herein, higher silicon contents can enable faster cooling rates.

DETAILED DESCRIPTION OF PREFERRED EMBODIMENTS

Illustrative, non-limiting examples of chromium white iron compositions for use in castings or weld deposits in accordance with the present invention are set out in Tables I and II. Table I sets out the compositions of Group I, which cover the compositions at points A, B, C, D and E shown in FIG. 1. Table II covers similar compositions that for reasons detailed above, differ in that they include niobium and/or vanadium.

TABLE I

| Group I Composition Ranges | | | | | | |
|---|---|---|---|---|---|---|
| Microstructure | C % | Cr % | Nb/V % | Mn % | Ni % | Si % |
| Hypoeutectic | 1.0 to 3.0 | 18.0 to 27.0 | nil | 4.0 to 8.0 | 4.0 to 8.0 | 0.25 to 2.75 |
| Eutectic | 3.0 to 4.0 | 15.0 to 27.0 | nil | 4.0 to 8.0 | 4.0 to 8.0 | 0.25 to 2.75 |
| Hypereutectic | 4.0 to 5.0 | 20.0 to 27.0 | nil | 4.0 to 8.0 | 4.0 to 8.0 | 0.25 to 3.25 |

TABLE II

| Group II Composition Ranges | | | | | | |
|---|---|---|---|---|---|---|
| Microstructure | C % | Cr % | Nb/V % | Mn % | Ni % | Si % |
| Hypoeutectic | 2.5 to 4.0 | 18.0 to 27.0 | 10.0 | 4.0 to 8.0 | 4.0 to 8.0 | 0.25 to 2.75 |
| Eutectic | 4.25 to 4.75 | 15.0 to 27.0 | 10.0 | 4.0 to 8.0 | 4.0 to 8.0 | 0.25 to 2.75 |
| Hypereutectic | 5.0 to 6.0 | 20.0 to 27.0 | 10.0 | 4.0 to 8.0 | 4.0 to 8.0 | 0.25 to 3.25 |

Notes:

1. In the ranges for each of Tables I and II, the balance of the composition is iron and incidental impurities. However, alloying elements may be added as mentioned above.
2. In the ranges for Table II, niobium and the vanadium may both be provided in amounts within the range of up to 10%, with the preferred total amount being 10%. Also, the carbides resulting from the introduction of the Nb and/or V necessitates the additional carbon shown.

Illustrative Examples

Castings

A high chromium white iron casting, which had been subjected to industrial use was cut up to provide segments from which specimens for microstructural characterisation were obtained. The segments were cut using abrasive water-jet cutting. The specimens were cut from the segments with a thin carborundum rotating disc (wafer disc) cooled with copious amounts of a water based coolant. The specimens were examined using an Olympus reflected light microscope at magnifications up to and including ×500. The specimens were examined in the unetched and etched conditions. The etchant was acid ferric chloride (5 g $FeCl_3$, 10 ml HCl, 100 ml $H_2O$).

FIG. 2 is a photomicrograph of polished and acid ferric chloride etched section of a specimen taken from the industry casting. The field of FIG. 2 is at the intersection of a subsurface crack and a surface breaking crack. These are large cracks and probably occurred during cooling down after solidification of the casting. A higher resolution photomicrograph of the same section, taken just to the left of the intersection between the cracks, is shown in FIG. 3.

Figure 3:
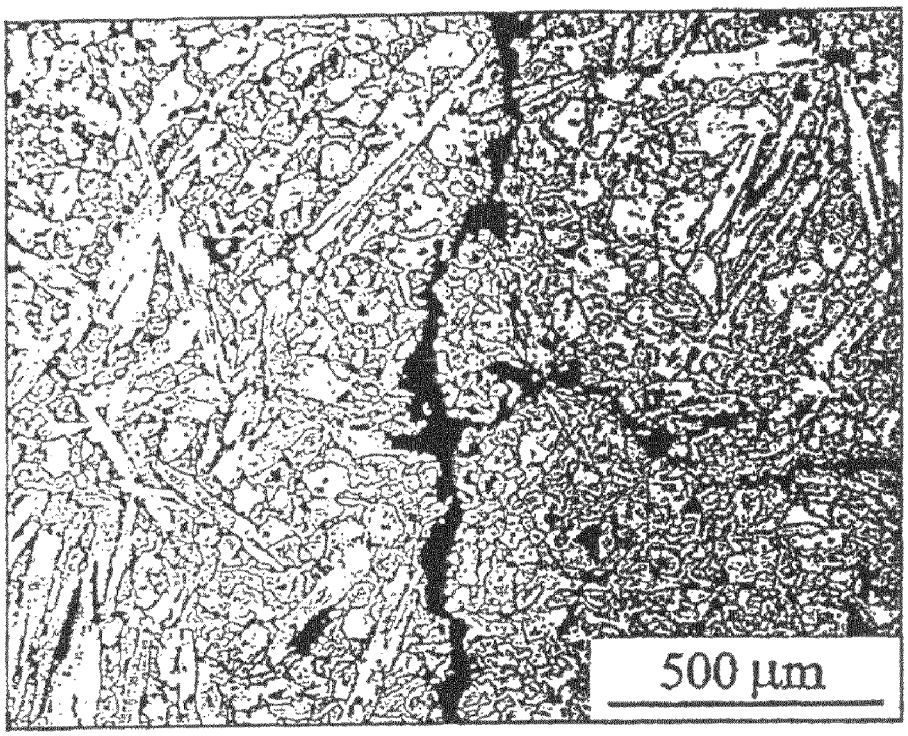
FIG. 3 is a photomicrograph of part of the field of FIG. 2, but at a higher magnification.

The microstructure of FIGS. 2 and 3 shows the industry casting to be in the as-cast condition. The chromium white iron of the industry casting from which FIGS. 2 and 3 were derived was a hypereutectic composition shown in Table III.

TABLE III

| Industry Casting Composition % | | | | | | | |
|---|---|---|---|---|---|---|---|
| C | Mn | Si | Ni | Cr | Mo | Cu | Fe/Impurities |
| 4.5 | 1.90 | 0.49 | 0.12 | 34 | 0.95 | 0.07 | Balance |

As can be recognised from FIGS. 2 and 3, the microstructure exhibits only primary $M_7C_3$ carbide and austenite at the respective magnifications shown. The microstructure thus is significantly different to that of the usual high chromium white iron despite similar white iron composition. In FIGS. 2 and 3, there is no regular $M_7C_3$ eutectic carbide within the austenite. In the case of a regular eutectic, it is the growth of one eutectic phase which enriches the solution to form the second phase. This difference is believed to be due to inoculation of the melt from which the industry casting was made, with the effect of the inoculant being to nucleate $M_7C_3$ carbide during solidification. The driving force for the growth of the carbide was sufficient for the carbide to solidify independently of the austenite and, hence, a divorced eutectic resulted.

The microstructure shown in FIGS. 2 and 3 has primary $M_7C_3$ carbides (white) in a divorced eutectic microstructure. A complex regular structure, with its interconnected carbide rods, has been avoided. This is beneficial since the preferred crack path in high chromium white iron weld deposits and castings is along the interface between the $M_7C_3$ carbides and the austenite. The interconnected complex regular eutectic carbide structure provides long continuous paths along which cracks can propagate, making elimination of that structure desirable. However, despite this being achieved in the as cast microstructure shown in FIGS. 2 and 3, cracking still has occurred. The reason for this is evident from FIG. 4.

Figure 4:
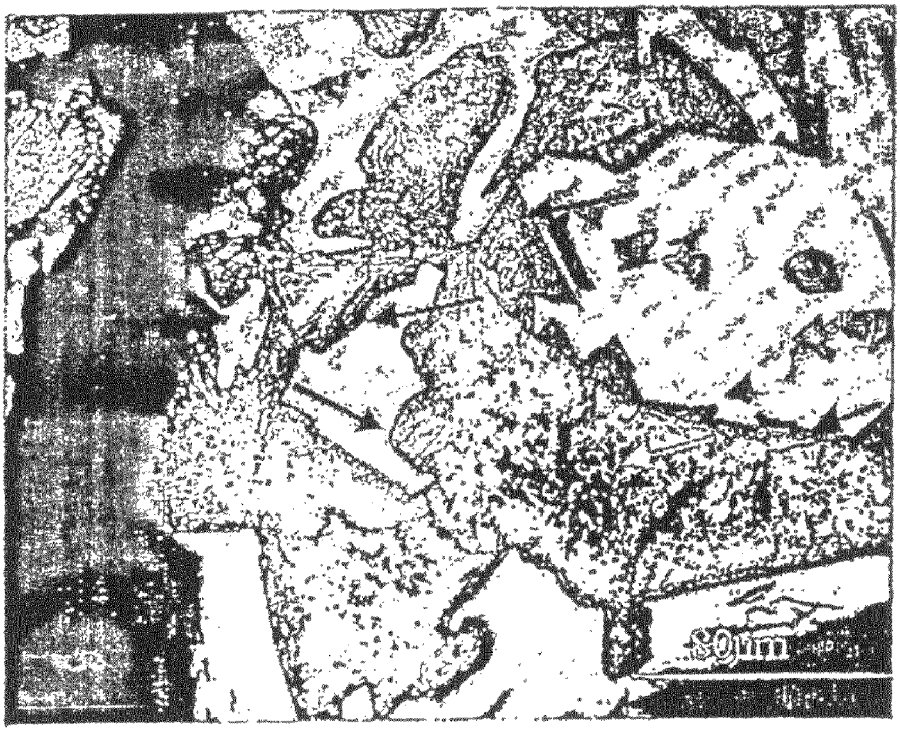
FIG. 4 is a photomicrograph of a part of the field of FIG. 2, but at a still higher magnification.

The higher magnification of FIG. 4 was taken just above the intersection of the cracks shown in FIG. 2, just to the right of the vertical crack. In FIG. 4, the lighter coloured phase is the primary $M_7C_3$ carbide, while the darker matrix predominantly is divorced eutectic austenite. However, the edge regions of the austenite, at interfaces between the austenite and $M_7C_3$ carbide, have a layer of martensite indicated by black arrows. Also, the white arrow is pointing to a region of precipitated $M_{23}C_6$ carbide within the austenite.

The martensite forms a continuous layer at the $M_7C_3$ carbide-austenite interfaces, as has been established by transmission electron microscopy (TEM). In FIG. 4, the black arrows only indicate regions where the martensite is resolvable at the magnification of FIG. 4. Indeed, TEM shows that the martensite layer is actually composed of two very thin martensite layers. These include a thin, very brittle high carbon martensite layer adjacent to the $M_7C_3$ carbide and a layer of less brittle, lower carbon martensite adjacent to the austenite. However, even at the resolution of FIG. 4, some martensite needles can be seen extending some distance from the interface into the austenite.

To minimise cracking, the composition of most commercial high chromium white iron castings is limited to compositions up to eutectic composition. However it is generally accepted that the wear rate of high chromium white irons is directly related to the volume fraction of $M_7C_3$ carbide, both primary and eutectic, and therefore hypoeutectic alloys and eutectic alloys have a higher wear rate than hypereutectic alloys in most circumstances. The choice of the hypoeutectic and eutectic compositions can minimise cracking by minimising the interfacial area between the $M_7C_3$ carbide and the austenite, which we find is the preferred crack path due to the interfacial layer of martensite. The commercial alloy of FIGS. 2 to 4 has a hypereutectic composition and, as indicated, the sample supplied contained cracks and interfacial martensite.

Figure 5:
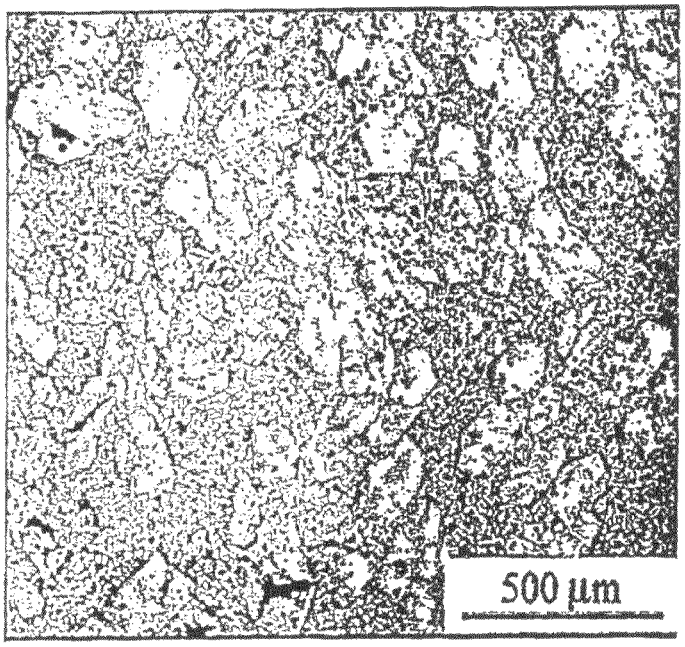
FIG. 5 is a photomicrograph of a sample taken from a hypereutectic casting using a chromium white iron composition according to the present invention.

High chromium white irons according to the present invention can be hypoeutectic, eutectic or hypereutectic, and can be used in either the as-cast or heat-treated condition. Two compositions of hypereutectic have been trialled using small slowly cooled crucible castings. A micrograph of an acid ferric chloride etched sample from one of the small slowly cooled crucible castings is shown in FIG. 5, while the trialled compositions are set out in Table IV.

TABLE IV

Hypereutectic Casting Compositions According to the Invention

| | C | Mn | Si | Cr | Ni | Fe/Impurities |
|---|---|---|---|---|---|---|
| Alloy 1: | 4.25 | 9.31 | 2.18 | 27.45 | 4.07 | Balance |
| Alloy 2: | 4.73 | 11.16 | 1.39 | 28.56 | 8.46 | balance |

Figure 6:
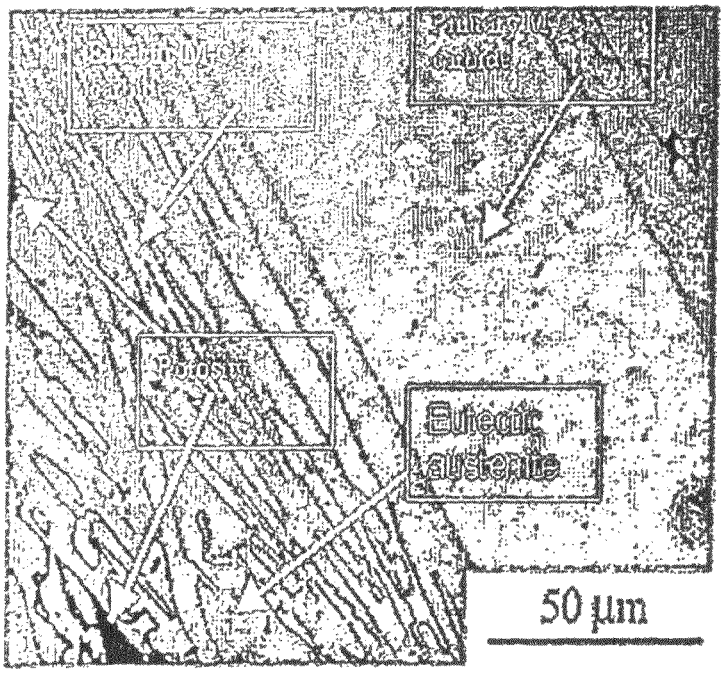
FIG. 6 is a photomicrograph of a sample taken from the same casting as FIG. 5, but at a higher magnification.

There are important features in FIG. 5. The light etched phase is the hexagonal primary $M_7C_3$ carbide rods and these are surrounded by an austenite halo. At the resolution of FIG. 5 (which is similar to that of FIG. 2) there does not appear to be a dark layer of interfacial martensite at the interface between either the primary or eutectic $M_7C_3$ carbides and the austenite. FIG. 6 enables closer scrutiny using optical microscopy (at a resolution better than FIG. 4), but also failed to reveal any martensite at the interface. The large volume of primary carbides in the microstructure indicates that the alloy is of hypereutectic composition. As stated earlier, the wear resistance increases with increasing volume fraction of carbides, particularly primary carbides.

In spite of the porosity and the hypereutectic composition there were no indications that the crucible castings contained any cracks.

Thus, in summary, the industry casting microstructure of FIGS. 2 to 4 contained fine primary $M_7C_3$ carbide in a divorced austenitic matrix indicating it was of hypereutectic composition and in the as-cast condition. The industry casting microstructure had an interfacial layer of martensite between the $M_7C_3$ carbide and the austenite. Due to the relatively slow cooling rate of the industry casting the martensite layer could be resolved in the optical microscope. The present invention enables the interfacial martensite to be avoided.

In contrast, the microstructure of the slowly cooled castings of the trial compositions according to the present invention showed that the castings were of hypereutectic composition, that the castings did not show any evidence of martensite at the interfacial regions and that there were no cracks evident.

While the compositions in accordance with the invention were not subjected to TEM, a further simple test is able to show the presence or absence, respectively, of martensite in the microstructure of FIGS. 2 to 4, and that of FIGS. 5 and 6. With each of the hypereutectic chromium white irons, the only ferromagnetic phase potentially present in the as-cast condition is martensite. The industry casting from which the photomicrographs of FIGS. 2 to 4 were derived was ferromagnetic and able to strongly attract a magnet, clearly indicating the presence of martensite. The casting from which FIGS. 5 and 6 were derived and other castings based on the compositions of Table IV did not attract a magnet, clearly indicating the absence of martensite.

Illustrative Examples

Weld Deposition

With weld disposition or hardfacing, the invention again enables the substantially complete prevention of formation of a martensite layer at the interfaces between $M_7C_3$ carbides and austenite. This is achieved in essentially the same way as described for castings, by a suitable balance between silicon as a martensite promoter and the austenite stabilisers manganese and nickel. However, in weld deposition, a further significant benefit can be achieved. This is the avoidance of check cracking as a consequence of the prevention of martensite formation and also a reduction in the level of interconnectivity of $M_7C_3$ carbides. The latter result is illustrated in the following.

Several industry samples consisting of a weld deposited overlay of a hypereutectic high chromium white iron hardfacing, on a steel substrate, were examined. In each case, the white iron hardfacing exhibited check cracking. The macrograph of FIG. 7 provides a good representative illustration of the check cracking. As is evident in FIG. 7 the check cracking extended over the entire hardfacing, in a 5 to 10 mm mesh, as confirmed by the cm rule shown. In most instances, the cracks extended radially through the thickness of the hardfacing to the substrate-hardface interface.

Identical sample preparation techniques were used for each of the industry samples. The preparation of samples involved selecting sections and plasma cutting them to a size suitable for manipulation in an abrasive cutter. Samples for metallographic examination were sectioned using a carborundum abrasive disk and water based lubricant at a suitable distance from the plasma cut region to ensure no microstructural changes took place due to heating during cutting. Approximate 25 millimeters long by 10 millimeters wide sections were taken transversely and longitudinally to the direction of the weld beads. The viewing plane of the transverse samples is across consecutive weld beads and along a weld bead for the longitudinal sample. These sections were polished using five grades of silicon carbide paper and polished to a 1-micron finish using diamond paste. The polished samples were etched in acid ferric chloride (5 g $FeCl_3$, 10 ml HCl, 100 ml $H_2O$) for viewing under an optical light microscope.

Figure 8A:
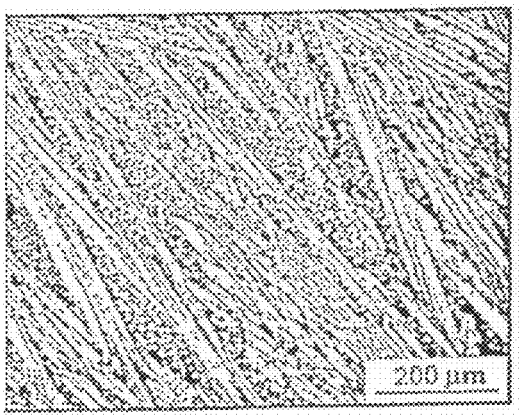
Figure 8B:
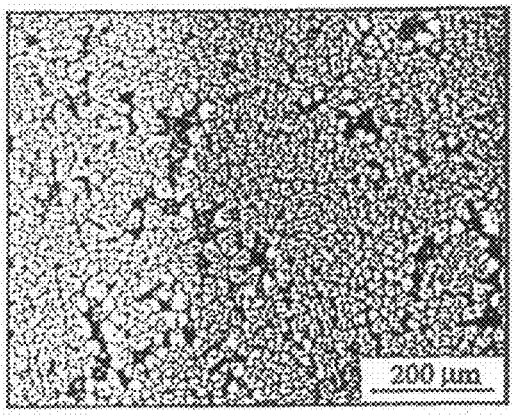

Representative industry samples of the hardfacing shown in FIG. 7 were taken transversely and longitudinally to the weld beads and metallographically prepared. FIGS. 8*a* and 8*b* show the respective microstructures in which acid ferric chloride etching shows the hypereutectic composition of the high chromium white iron is indicated by the presence of primary $M_7C_3$ carbides. The chemical composition of the hardfacing shown in FIG. 7 is identified in Table V as Sample I, with the composition of the hardfacing of some other industry samples being shown as samples II and III.

TABLE V

Industry Hardfacing Compositions

| Sample | C | Si | Cr | Mn | Fe/Impurities |
|---|---|---|---|---|---|
| I | 4.9 | 0.94 | 27.3 | 1.2 | Balance |
| II | 5.0 | 1.1 | 25.2 | 1.34 | Balance |
| III | 4.6 | 1.2 | 18.7 | 1.19 | Balance |

The most common feature of the examined industry samples was check cracking. All samples contained check cracking in the range of a 5 to 10 millimeter mesh over the entire surface of the hardfacing overlay. The majority of check cracks extended to the substrate-hardface interface. In some instances the check cracks further branched and propagated along the substrate-hardface interface. The propagation of interface cracks could lead to sections of the overlay being removed from the surface.

The microstructure of the overlay gives rise to its wear properties and so is important for optimising wear performance. The overlay microstructure in the examined samples was a hypereutectic high chromium white iron microstructure consisting of primary $M_7C_3$ carbide rods in a eutectic composition of austenite and eutectic $M_7C_3$ carbides. However, the microstructures examined also consisted of undesirable features such as complex regular and interconnected carbides.

FIG. 9 shows a desirable microstructure for as deposited hardfacing. FIG. 9 is from Sample II in Table V, but is not representative of that sample or any other sample. The microstructure of FIG. 9 has been etched in acid ferric chloride. The microstructure consists of hexagonal rods of primary $M_7C_3$ carbide (white) in a eutectic matrix of $M_7C_3$ carbide and austenite. The primary carbide rods are almost perpendicular to the plane in which FIG. 9 was taken and hence appear almost hexagonal, while cellular austenite halos are evident around the primary carbides. The appearance of the carbide rods will vary depending on their orientation, so rather than appearing as hexagons, the primary carbides have a long rod like shape in sections extending perpendicular to the plane in which the photomicrograph of FIG. 9 was taken.

When there is sufficient undercooling of the melt, i.e. cooling of the liquid below its normal solidification temperature, before solidification actually occurs, then the normal eutectic as seen in FIG. 9 is not produced, but rather an interconnected branched array of finer carbide rods in austenite as shown in FIG. 10, taken from Sample III of Table V. The microstructure of FIG. 10 is representative of all samples, including Sample II from which the non-representative microstructure of FIG. 9 was taken.

In FIG. 10, for which acid ferric chloride etchant again was used, the eutectic is still made up of a mixture of $M_7C_3$ carbide rods (white) and austenite, with the orientation of the carbide rods being roughly planar to the section on which FIG. 10 was taken. This undercooled eutectic is referred to as a complex regular eutectic. The eutectic rods are about one fifth the diameter of the primary carbide rods shown in FIG. 9 and have a three-fold rotational symmetry which gives rise to the triangular appearance of the carbide clusters. Due to the interconnectivity of the rods this microstructure provides long interconnected paths for crack propagation. The microstructure of FIG. 10 therefore is highly undesirable, although it is usual in weld deposited high chromium white irons prior to the present invention.

We have previously shown by electron backscatter diffraction (EBSD) and X-ray diffraction of deep etched samples that the carbide rods in all of these equilateral triangles of complex regular eutectic are interconnected. The carbide rods in the complex regular are $M_7C_3$ and have the same hexagonal cross section as the primary $M_7C_3$ carbides, although the complex regular carbides are finer, by approximately 5 times, than the primary carbides. It is not uncommon for "grains" of complex regular structure to be measured in millimeters. Cracking through this complex regular microstructure is shown in more detail in FIGS. 11(*a*) and 11(*b*) for sample II.

The more desirable eutectic microstructure is shown in FIG. 9, also for Sample II, because there is considerably reduced interconnectivity of the rods in the eutectic. The microstructure comprises rods of primary $M_7C_3$ in a matrix of eutectic $M_7C_3$ and austenite, and a substantial absence of the complex regular microstructure with its attendant interconnected carbide.

There are other high chromium white iron microstructures where the carbides are interconnected and contribute to the embrittlement of hypereutectic high chromium white iron weld deposits. These are when branched primary $M_7C_3$ carbides are present, as in FIG. 12 for Sample III, or a mixture of branched primary $M_7C_3$ and the complex regular structure is present, as in FIG. 13 also from Sample III. Increasing the silicon content of the alloy or increasing the cooling rate tends to promote these two structures.

As mentioned, the branched primary carbides and the complex regular microstructure are favoured by high silicon contents, and the faster cooling rates inherent in weld deposition, which result in undercooling. The growth of these carbides is not determined by the thermal gradient but by the degree of undercooling. Undercooling occurs more readily adjacent to the substrate and hence these carbides can grow in a direction parallel to the substrate rather than perpendicular to the substrate, which is what would be expected if the growth was controlled by the thermal gradient.

This provides one explanation for the check cracking seen in the hardfacing of the industry samples. As shown in FIG. 7, the check cracking appears as a square mesh at the surface of the overlay although they have been initiated close to the surface of the substrate. Those appearing at the surface of the overlay have therefore propagated all the way from the substrate to the overlay surface. This cracking pattern is a result of the effect of residual stress due to solidification of the weld bead and the alignment of the carbide rods. Away from the substrate the carbides are likely to grow parallel to the thermal gradient, that is at right angles to the substrate.

A further explanation is provided by close examination of the electron micrograph of FIG. 14. Sample III was the source for FIG. 14, although it is typical of the high magnification secondary electron images taken of the high chromium weld overlays of each of Samples I, II and III. Although FIG. 14 is an image of eutectic carbide and austenite the same discussion can be applied to primary carbides in an austenite matrix.

It has been well established that the preferred crack path in high chromium white iron overlays is along the interface between the carbide and the austenite. The thin dark region (less than 0.2 μm thick in the image of FIG. 14) surrounding the carbide particles is a thin layer of martensite. Martensite needles can also be seen to extend from these thin layers into the austenite. The brittle martensite surrounding the carbide particles provides an ideal path for crack propagation under conditions of residual stress. In the absence of this martensitic layer, the tougher austenite would be able to absorb the residual stresses and cracking at the interfaces between $M_7C_3$ carbide and austenite should not occur.

It can be concluded that the presence of branched primary carbide or complex regular, both of which have interconnected carbides, or the presence of martensite at the carbide austenite interface will promote cracking. If these constituents can be eliminated check cracking of the weld deposits should also be eliminated.

Two hypoeutectic, high chromium white irons have been weld deposited on a mild steel disc using plasma transferred arc (PTA). The powder compositions are set out in Table VI.

TABLE VI

| Depositions According to the Invention | | | | | | | |
|---|---|---|---|---|---|---|---|
| | C | Mn | Si | Cr | Ni | Mo | Fe/Impurities |
| Alloy 1 | 2.35 | 3.21 | 0.5 | 20.58 | 3.34 | 0.04 | Balance |
| Alloy 2 | 2.25 | 2.86 | 0.47 | 19.51 | 2.97 | 0.04 | Balance |

The weld depositions were found to be of excellent quality. FIG. 15 is a photomacrograph of a two layer weld deposited section which is typical of the deposits for each of the sections. As can be seen, the deposit has a smooth, glossy surface which is substantially free of slag and which does not exhibit any surface cracks. Also, presentation of a magnet to the weld deposit does not exhibit any ferromagnetic attraction indicative of the presence of martensite.

The above description in relation to Samples I, II and III, illustrated with reference to FIGS. 7 to 14, focuses principally on the adverse consequences of interconnectivity of $M_7C_3$ primary carbides. However, as indicated in relation to FIG. 14, those samples exhibited detectable martensite at $M_7C_3$ carbide and austenite interfaces, such that each of Samples I, II and III exhibited strong ferromagnetism able to be attributed only to the presence of the martensite. That is, the weld deposits of Samples I, II and III strongly attracted a magnet when presented to each of those deposits.

FIGS. 16 and 17 are photomicrographs respectively taken longitudinally and transversely with respect to a weld bead of the deposit.

As is evident from FIGS. 15, 16 and 17, the weld deposit were substantially crack free. The microstructure is characterised by dendrites and a eutectic of $M_7C_3$ and austenite and an absence of martensite at $M_7C_3$ carbide and austenite interfaces. Also, the $M_7C_3$ carbide shows a low level of interconnectivity. Both powders resulted in excellent fluidity, while the level of dilution was good in being approximately 10 to 25%. The substrate preheat level required was much lower than used in current practice, at 150° C. rather than about 300° C.

Finally, it will be appreciated that there may be other modifications and changes made to the embodiments described above that may also be within the scope of the present invention.

What is claimed is:

1. A wear resistant, high chromium white iron with an amount of chromium of 15-27% and of carbon of 2.5-6%, wherein said white iron in an unheat-treated condition has a microstructure including austenite and $M_7C_3$ carbides, the white iron containing a martensite promoter being silicon at a level from 0.25 to 3.5% and at least two austenite stabilizers are present, and the combined level of austenite stabilizer is not in excess of about 20%, one of the austenite stabilizers being nickel at a level of from 4 to 12% with at least one other austenite stabilizer selected from the group of manganese, copper and molybdenum at a level of from 4 to 12% for each of manganese, and copper, and an effective equivalent of molybdenum after allowance for a proportion of molybdenum taken up as carbide, and wherein the level of the martensite promoter and the level of the austenite stabilizer are selected so as to achieve a balance between their effects such that the white iron in an unheat-treated condition has a microstructure that is free of martensite at interfaces between the austenite and $M_7C_3$ carbides such that the white iron is substantially crack-free.

2. A wear resistant, high chromium white iron with an amount of chromium of 15-27% and of carbon of 2.5-6%, wherein said white iron in an unheat-treated condition has a microstructure including austenite and $M_7C_3$ carbides, the white iron containing a martensite promoter being silicon at a level from 0.25 to 3.5% and at least two austenite stabilizers are present, and the combined level of austenite stabilizer is not in excess of about 16%, one of the austenite stabilizers being nickel at a level of from 4 to 12% with at least one other austenite stabilizer selected from the group of manganese, copper and molybdenum at a level of from 4 to 12% for each of manganese, and copper, and an effective equivalent of molybdenum after allowance for a proportion of molybdenum taken up as carbide, and wherein the level of the martensite promoter and the level of the austenite stabilizer are selected so as to achieve a balance between their effects such that the white iron in an unheat-treated condition has a microstructure that is free of martensite at interfaces between the austenite and $M_7C_3$ carbides such that the white iron is substantially crack-free.

3. The white iron of claim 1, wherein said white iron is in an as-cast condition and said respective levels achieve a balance whereby the white iron is free of martensite at interfaces between the austenite and $M_7C_3$ carbides.

4. The white iron of claim 1, wherein said white iron comprises hardfacing provided over a substrate by welded deposition, and wherein said hardfacing is substantially free of check cracking.

5. The white iron of claim 4, wherein the balance between the effects of the martensite promoter and the austenite stabilizer is such that $M_7C_3$ carbides of said microstructure exhibits a relatively low level of interconnectivity between carbide particles.

6. The white iron of claim 5, wherein the low level of interconnectivity is such that the microstructure is substantially free of branched carbide particles and said respective levels achieve a balance whereby the white iron is free of martensite at interfaces between the austenite and $M_7C_3$ carbides.

7. The white iron of claim 1, wherein said white iron is of a hypoeutectic composition, and said interfaces include interfaces between primary austenite and eutectic $M_7C_3$ carbide and between eutectic austenite and eutectic $M_7C_3$ carbide.

8. The white iron of claim 1, wherein said white iron is of a eutectic composition, with said interfaces being between eutectic austenite and eutectic $M_7C_3$ carbide.

9. The white iron of claim 1, wherein said white iron is of a hypereutectic composition, and said interfaces include interfaces between primary $M_7C_3$ carbide and eutectic austenite and between eutectic austenite and eutectic $M_7C_3$ carbide.

10. The white iron of claim 7, wherein the white iron has 2.5 to 4.0% C, 18.0 to 27.0% Cr, Mn and Ni each at 4.0 to 8.0%, 0.25 to 2.75% Si, up to 10% each of at least one of Nb and V, and a balance, apart from other incidental alloying elements and impurities, of Fe.

11. The white iron of claim 8, wherein the white iron has from 3.0 to 4.0% C, 15.0 to 27.0% Cr, Mn and Ni each at 4.0 to 8.0%, 0.25 to 2.75% Si, and a balance, apart from other incidental alloy elements and impurities, of Fe.

12. The white iron of claim 8, wherein the white iron has 4.25 to 4.75% C, 15.0 to 27.0% Cr, Mn and Ni each at 4.0 to 8.0%, 0.25 to 2.75% Si, up to 10% each of at least one of Nb and V, and a balance, apart from other incidental alloying elements and impurities, of Fe.

13. The white iron of claim 9, wherein the white iron has from 4.0 to 5.0% C, 20.0 to 27.0% Cr, Mn and Ni each at 4.0 to 8.0%, 0.25 to 2.75% Si, and a balance, apart from other incidental alloy elements and impurities, of Fe.

14. The white iron of claim 9, wherein the white iron has 5.0 to 6.0% C, 20.0 to 27.0% Cr, Mn and Ni each at 4.0 to 8.0%, 0.25 to 2.75% Si, up to 10% each of at least one of Nb and V, and a balance, apart from other incidental alloying elements and impurities, of Fe.

15. A method of producing a wear resistant, high chromium white iron casting with an amount of chromium of 15-27% and of carbon of 2.5-6%, the method comprising:

casting a melt of a high chromium white cast iron, wherein said melt contains a martensite promoter being silicon at a level from 0.25 to 3.5%, and at least two austenite stabilizers are present, and the combined level of austenite stabilizer is not in excess of about 20%, one of the austenite stabilizers being nickel at a level of from 4 to 12% with at least one other austenite stabilizer selected from the group of manganese, nickel, copper and molybdenum at a level of from 4 to 12% for each of manganese, and copper, and an effective equivalent of molybdenum after allowance for a proportion of molybdenum taken up as carbide, cooling the melt so as to produce a casting having a microstructure which in an unheat-treated condition includes austenite and $M_7C_3$ carbides, wherein the level of the martensite promoter in the melt, the level of the austenite stabilizer in the melt and the cooling rate are selected so as to achieve a balance between the effects of these variables, to thus obtain a white iron casting which in an unheat-treated condition has a microstructure that is free of martensite at interfaces between the austenite and $M_7C_3$ carbides such that the white iron is substantially crack-free.

16. A method of producing a wear resistant, high chromium white iron hardfacing with an amount of chromium of 15-27% and of carbon of 2.5-6%, the method comprising:

applying a high chromium white cast iron material to a substrate by weld deposition, wherein said high chromium white cast iron material contains a martensite promoter being silicon at a level from 0.25 to 3.5%, and at least two austenite stabilizers are present, and the combined level of austenite stabilizer is not in excess of about 20%, one of the austenite stabilizers being nickel at a level of from 4 to 12% with at least one other austenite stabilizer selected from the group of manganese, nickel, copper and molybdenum at a level of from 4 to 12% for each of manganese, and copper, and an effective equivalent of molybdenum after allowance for a proportion of molybdenum taken up as carbide, cooling the high chromium white cast iron material so as to produce on the substrate a hardfacing having a microstructure which in an unheat-treated condition includes austenite and $M_7C_3$ carbides, wherein the level of the martensite promoter in the high chromium white cast iron material, the level of the austenite stabilizer in the high chromium white cast iron material and the cooling rate are selected so as to achieve a balance between the effects of these variables and to thus obtain on the substrate a hardfacing which in an unheat-treated condition has a microstructure that is free of martensite at interfaces between the austenite and $M_7C_3$ carbides—such that the hardfacing is substantially crack-free.

17. A method of producing a wear resistant, high chromium white iron casting with an amount of chromium of 15-27% and of carbon of 2.5-6%, the method comprising:

casting a melt of a high chromium white cast iron, wherein said melt contains a martensite promoter being silicon at a level from 0.25 to 3.5%, and at least two austenite stabilizers are present, and the combined level of austenite stabilizer is not in excess of about 16%, one of the austenite stabilizers being nickel at a level of from 4 to 12% with at least one other austenite stabilizer selected from the group of manganese, nickel, copper and molybdenum at a level of from 4 to 12% for each of manganese, and copper, and an effective equivalent of molybdenum after allowance for a proportion of molybdenum taken up as carbide, cooling the melt so as to produce a casting having a microstructure which in an unheat-treated condition includes austenite and $M_7C_3$ carbides, wherein the level of the martensite promoter in the melt, the level of the austenite stabilizer in the melt and the cooling rate are selected so as to achieve a balance between the effects of these variables, to thus obtain a white iron casting which in an unheat-treated condition has a microstructure that is free of martensite at interfaces between the austenite and $M_7C_3$ carbides such that the white iron is substantially crack-free.

18. A method of producing a wear resistant, high chromium white iron hardfacing with an amount of chromium of 15-27% and of carbon of 2.5-6%, the method comprising:

applying a high chromium white cast iron material to a substrate by weld deposition, wherein said high chromium white cast iron material contains a martensite promoter being silicon at a level from 0.25 to 3.5%, and at least two austenite stabilizers are present, and the combined level of austenite stabilizer is not in excess of about 16%, one of the austenite stabilizers being nickel at a level of from 4 to 12% with at least one other austenite stabilizer selected from the group of manganese, nickel, copper and molybdenum at a level of from 4 to 12% for each of manganese, and copper, and an effective equivalent of molybdenum after allowance for a proportion of molybdenum taken up as carbide, cooling the high chromium white cast iron material so as to produce on the substrate a hardfacing having a microstructure which in an unheat-treated condition includes austenite and $M_7C_3$ carbides, wherein the level of the martensite promoter in the high chromium white cast iron material, the level of the austenite stabilizer in the high chromium white cast iron material and the cooling rate are selected so as to achieve a balance between the effects of these variables and to thus obtain on the substrate a hardfacing which in an unheat-treated condition has a microstructure that is free of martensite at interfaces between the austenite and $M_7C_3$ carbides—such that the hardfacing is substantially crack-free.

* * * * *